US006415871B2

(12) United States Patent
Sundholm

(10) Patent No.: US 6,415,871 B2
(45) **Date of Patent: *Jul. 9, 2002**

(54) INSTALLATION FOR FIGHTING FIRE

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/818,233

(22) Filed: Mar. 27, 2001

Related U.S. Application Data

(63) Continuation-in-part of application No. PCT/FI00/00865, filed on Oct. 6, 2000.

(30) Foreign Application Priority Data

| | | |
|---|---|---|
| Oct. 8, 1999 | (FI) | 19992172 |
| Oct. 19, 1999 | (FI) | 19992257 |
| Oct. 26, 1999 | (FI) | 19992312 |

(51) Int. Cl.[7] ..... A62C 37/00

(52) U.S. Cl. ..... 169/54; 169/16; 169/37; 169/62

(58) Field of Search ..... 169/16, 37, 54, 169/55, 62, 64; 239/548, 556, 559

(56) References Cited

U.S. PATENT DOCUMENTS

| | | | | |
|---|---|---|---|---|
| 4,091,876 A | * | 5/1978 | Valdatta | |
| 4,989,675 A | * | 2/1991 | Papavergos | |
| 5,040,611 A | * | 8/1991 | Steel | |
| 5,188,186 A | * | 2/1993 | Nash | 169/54 X |
| 5,808,541 A | * | 9/1998 | Golden | |
| 6,065,546 A | * | 5/2000 | Uetake et al. | 169/16 X |
| 6,216,793 B1 | * | 4/2001 | Sundholm | 169/54 |

FOREIGN PATENT DOCUMENTS

| | | |
|---|---|---|
| FR | 2769508 | * 10/1997 |
| FR | 2793149 | * 11/2000 |
| GB | 2215204 | * 9/1989 |
| JP | 5-184693 | * 7/1993 |

* cited by examiner

*Primary Examiner*—Steven J. Ganey
(74) *Attorney, Agent, or Firm*—Ladas & Parry

(57) ABSTRACT

The invention relates to an installation for fighting fire in a space; the installation comprising a first spray head which is placed in the space close to a first longitudinal side wall and obliquely directed downwards at an angle of 40 to 70° in relation to a vertical plane and a second spray head which is placed in the space close to a second longitudinal side wall opposite the first side wall and obliquely directed downwards at an angle of 40 to 70° in relation to the vertical plane. In order to fight a fire efficiently in a the space, the installation comprises a high pressure drive source for feeding water based extinguishing medium; and the spray heads are placed at a height of 3,2 to 4 m above the floor of the space and arranged to spray at a spread angle of 45 to 120°.

20 Claims, 2 Drawing Sheets

INSTALLATION FOR FIGHTING FIRE

Figure 1:
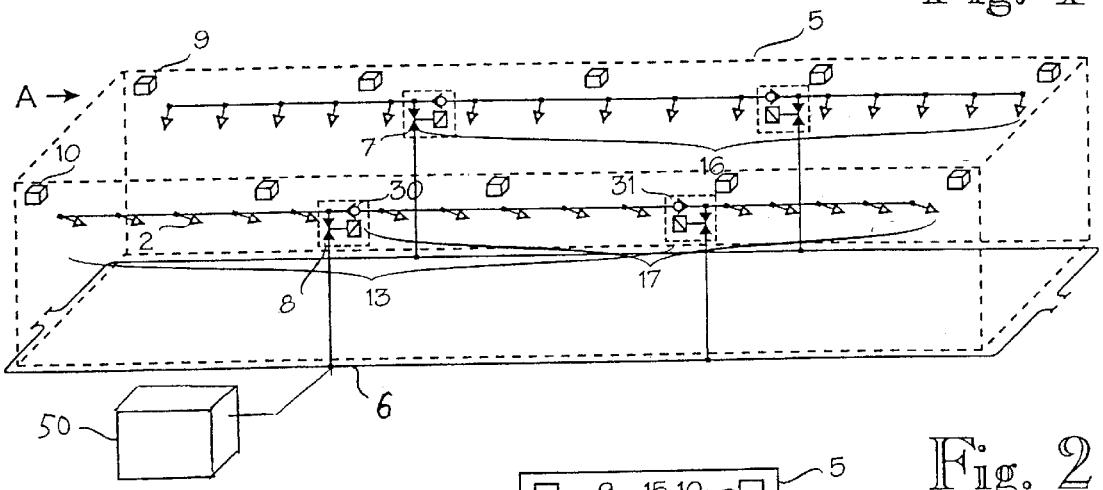

This application is a continuation-in-part of PCT/FI 00/00865, filed Oct. 6, 2000.

BACKGROUND OF THE INVENTION

The invention relates to an installation for fighting fire in a space. The space is preferably a railway carriage or a ship for transportation of lorries.

The invention also relates to an installation for fighting fire in a tunnel, preferably in a car or train tunnel.

Railway carriages transporting vehicles, such as lorries and trailers, are rarely equipped with fire fighting installations; the reason being the problematic surroundings for fire fighting installations. One problem is to fight and extinguish a fire that starts inside a covered trailer transported by the railway carriage. The fire is very difficult to fight and extinguish, since the top of the trailer is covered, typically with an aluminium cover, and the sides of the trailer are covered with a tarpaulin preventing the extinguishing medium from being sprayed from the outer side of the trailer into the goods space of the trailer. Owing to the above the goods that have caught fire have plenty of time to burn, and the fire may rapidly spread far, before the extinguishing medium is delivered to the fire area. If extinguishing medium is sprayed towards the side surfaces of the tarpaulin, said surfaces will only be cooled and protect the tarpaulin from burning, while the goods inside the tarpaulin can unimpededly continue to burn.

FR 2769508 discloses an installation for fighting fires on railway carriages for carrying vehicles. This known installation is designed in a traditional way to wet the whole vehicle with extinguishant in case of fire, whereby the spray heads are adapted to wholly cover the vehicle with extinguishant. In case of fire plenty of extinguishant is discharged.

Car tunnels are another problematic environment for fighting fire, which is why fire fighting installations are seldom installed therein. As regards fire fighting and extinguishing a similar problem to the one with railway carriage transportation arises when trailers and the like are transported in tunnels. Consequently, a possible fire fighting installation is rarely capable of preventing the goods in the trailer from burning.

BRIEF DESCRIPTION OF THE INVENTION

It is an object of the present invention to efficiently fight fire in trailers and the like when these are transported in spaces such as railway carriages and ships and the fire has started either inside or outside the trailer or the like. Another object of the invention is to efficiently fight fire in trailers and railway carriages when these travel through tunnels.

Said first object is achieved with an installation for fighting fire in a space, the space being bounded by a first longitudinal side wall; the installation comprising at least two spray heads whereof the first spray head is placed in the space close to the first longitudinal side wall and obliquely directed downwards at an angle of 40 to 70° in relation to a vertical plane and the and the second spray head is placed in the space close to a second longitudinal side wall of the space opposite the first side wall and obliquely directed downwards at an angle of 40 to 70° in relation to the vertical plane, and a drive source for feeding extinguishing medium to said at least two spray heads, the drive source is a high pressure drive source for feeding the extinguishing medium at a pressure of at least 15 bar; the extinguishing medium is a water-based extinguishing medium; and said two spray heads are placed at a height of 3,2 to 4 m above the floor of the space and arranged to spray water-based extinguishing medium at a spread angle of 45 to 120° and comprise at least two nozzles which are placed and directed in such a way that the spray heads at high pressure provide, in the direction in which the spray heads are directed, a mist-like spray with strong penetration power, and a suction at the respective spray head for sucking in flue gases into the spray of extinguishing medium and for enhancing the vaporization of the extinguishing medium.

The preferred embodiments of the invention are disclosed in the attached claims 1 to 13.

Said second object is achieved with an installation for fighting fire in a tunnel said installation comprising a high pressure drive source containing water-based extinguishing medium, and at least two spray heads, said drive source being adapted to feed water-based extinguishing medium to the spray heads, whereof the first spray head is placed close to a first longitudinal side wall of the tunnel and obliquely directed downwards at an angle of 40 to 70° in relation to a vertical plane of the tunnel and the second spray head is placed close to a second longitudinal side wall of the tunnel opposite the first side wall and obliquely directed downwards at an angle of 40 to 70° in relation to the vertical plane, the spray heads being placed at a height of 3,2 to 4 m above the floor level of the tunnel and arranged to spray water-based extinguishing medium at a spread angle of 45 to 120°. Preferably the spray heads comprise at least two nozzles which are placed and directed in such a way that the spray heads at high pressure provide, in the direction in which the spray heads are directed, a mist-like spray with strong penetration power, and a suction at the respective spray head for sucking in flue gases into the spray of extinguishing medium and for speeding up the vaporization of the extinguishing medium. Preferably the spray heads comprise at least two nozzles which are placed and directed in such a way that the spray heads at high pressure provide, in the direction in which the spray heads are directed, a mist-like spray with strong penetration power, and a suction at the respective spray head for sucking in flue gases into the spray of extinguishing medium and for enhancing the vaporization of the extinguishing medium. The tunnel is preferably-a car or a train tunnel.

The invention is based on the idea to place the spray heads on such a location in relation to the space, e.g. the railway carriage, that the spray heads, when activated, immediately spray extinguishing medium in the form of water-mist into the trailer after the fire has burnt holes on the tarpaulin, whereby the extinguishing medium is sprayed or injected with high momentum and penetrating power through the hole, and the spray heads are positioned so that they, on one hand, are directed towards the goods in the trailer for putting out the fire and, on the other hand, so that they are placed so high up that, when functioning, they suck heat from the hot flue gases, which enhances the vaporization of the water-based extinguishing medium used in the installation, whereby the area immediately above the fire is rapidly cooled down. By selecting a wide spread angle some of the extinguishing medium can be delivered into the areas where hot gas zones exist, thus preventing the flue gases from rapid and sudden ignition. Additionally the installation and method provide for effective fire protection of the whole vehicle from outside. Positioning of additional spray heads in an area below said hole of the tarpaulin makes the installation to work in a relatively inefficient way in putting out a fire which has started inside the vehicle (trailer), because such additional spray head(s) only cool down the tarpaulin and the discharged extinguishing medium does not affect the fire in any way. Therefore, spray heads are not positioned at a height of 0.5 to 3 m above the space (e.g. railway carriage).

The present invention very effectively and with the use of only little extinguishing medium puts out fires in the above described applications/environments.

BRIED DESCRIPTION OF THE DRAWINGS

Figure 2:
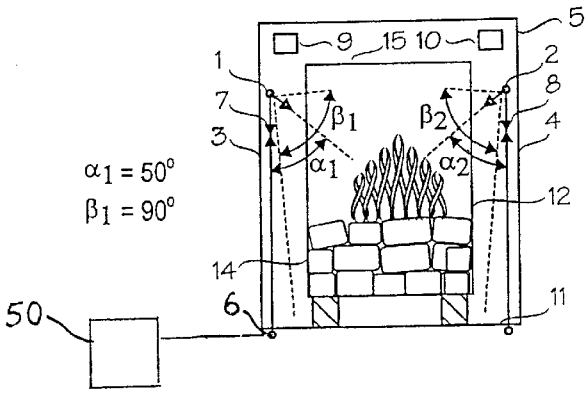
Figure 3:
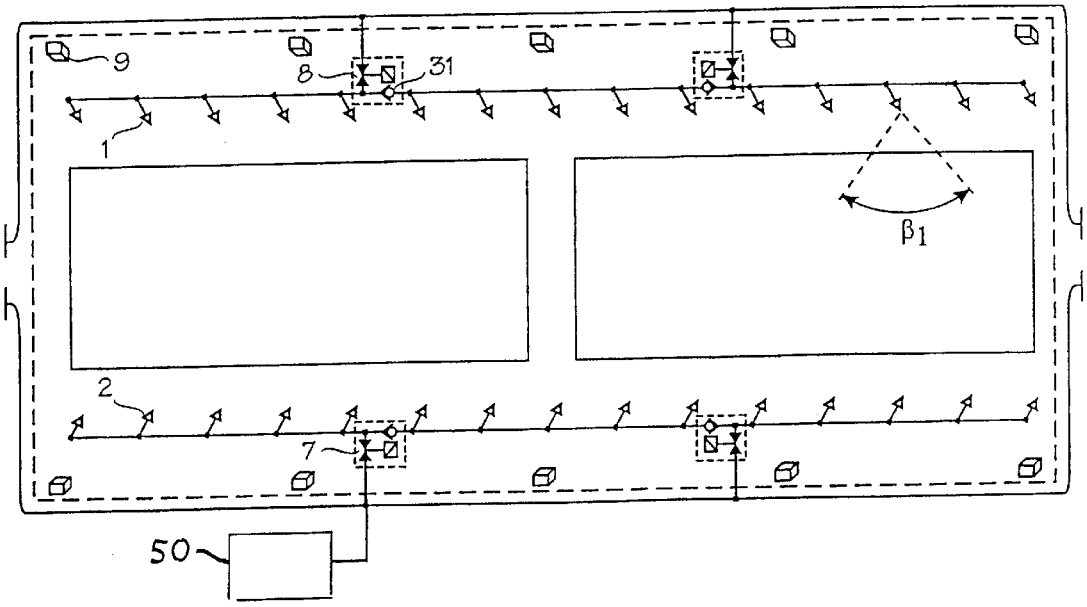
Figure 5:
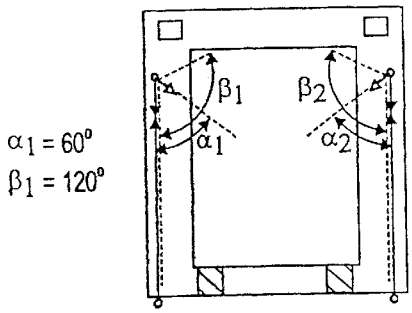
Figure 6:
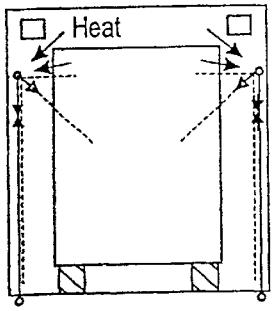
Figure 7:
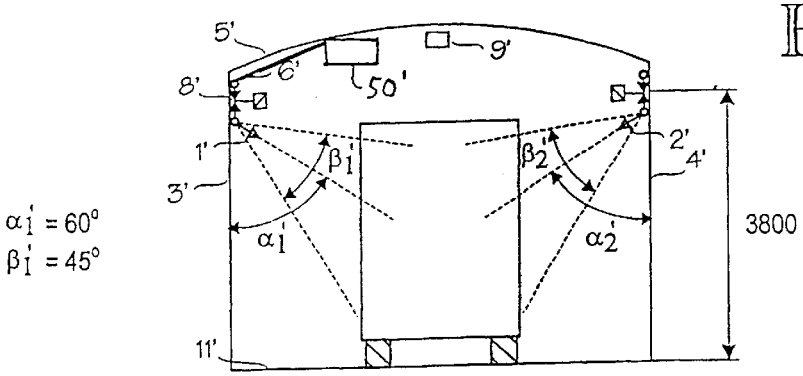
Figure 8:
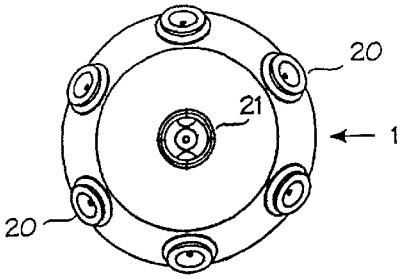

In the following the invention will be described in greater detail by means of two embodiments with reference to the accompanying drawing, in which FIG. 1 is a side view showing a fire fighting installation of the invention in a railway carriage, FIG. 2 shows the installation in FIG. 1 in the direction of arrow A and with a trailer, FIG. 3 is a top view showing the installation in FIG. 1, FIGS. 4 to 6 are corresponding views to FIG. 2 showing different spray head locations, FIG. 7 shows the installation of the invention in a tunnel, and FIG. 8 is a front view showing a spray head that can be used in the installation of the invention.

DETAILED DESCRIPTION OF THE INVENTION

FIGS. 1 and 2 show a railway carriage 5 with a fire fighting installation comprising several spray heads 1, 2 mounted along and close to both side walls 3, 4 of the railway carriage. The width-of the railway carriage, i.e. the distance between the side walls 3, 4 is 3 to 5 m. Reference numeral 6 refers to a pipe system for providing extinguishing medium in the form of water-based liquid through valves 7, 8 to the spray heads 1, 2. A high pressure drive source, for feeding water-based liquid into the pipe system 6, is indicated by reference number 50. The high pressure drive source 50, which provides a pressure of at least 15 bar and up to 200 and even 300 bar, can e.g. be a high pressure pump to which is coupled a container containing water-based liquid or it can be a hydraulic accumulator. The spray heads 1, 2 are preferably of a type comprising several side nozzles 20 an a central nozzle 21, see FIG. 8, and can at high working pressure of, for example, 20 to 200 bar produce extinguishing medium in the form of liquid mist with high penetration. Although FIG. 8 shows a spray head with multiple nozzles, a spray head with only two (or any number above two) divergent nozzles can be employed. The spray heads 1, 2 may preferably be constructed as presented in WO 92/20453. A number of detectors 9, 10 are placed at the ceiling level of the railway carriages. In case of fire these detectors 9, 10 provide a signal that opens the respective valves 7 and 8. Detector 9, for example, opens the valve 7, whereafter extinguishing medium can flow into the spray head 1.

The spray heads 1, 2 are obliquely directed downwards at an angle $\alpha 1$ of 50° in relation to a vertical side plane. The angle of departure, i.e. the spread or output angle $\beta 1=\beta 2$ of the spray heads 1, 2 is 90°. The spray heads 1, 2 are placed at a height of 3,5 m above the floor 11.

Reference numeral 12 refers to a trailer with an aluminium roof (cover) and a tarpaulin of plastic material. The tarpaulin covers the sides 130, 140 of the trailer 12.

If a fire starts in the trailer 12, the fire continues until a hole appears in the tarpaulin. As the heat from the fire is directed upwards, the hole caused by the fire always appears at the top of the tarpaulin, close to the trailer ceiling 15. When fire is detected, the respective valve is provided with a signal. If, for example, the detector 10 detects the fire, the detector provides the valve 8 with a signal so as to open it, and extinguishing medium can flow into and out from the spray heads 2 in a fire fighting zone 13. A check valve 31 prevents the extinguishing liquid from flowing to the last five spray heads on the right, which are part of an adjacent fire fighting zone 17. One or more of the spray heads 2 thus spray extinguishing medium mist obliquely downwards towards the burning goods 14. A central extinguishing medium jet forms the angle $\alpha 1=50°$ with a vertical side plane. This jet suppresses the fire and rapidly cools the location of the fire by vaporizing the extinguishing medium. The vaporization occurs rapidly, since hot flue gases are present around the spray heads and these hot gases are sucked into the extinguishing medium jet (spray) that is directed towards the seat of fire. Owing to the wide spread angle $\beta 1=\beta 2$, a part of the extinguishing medium is sprayed almost directly downwards to a lower peripheral area in order to cool the tarpaulin/the goods. Another part of the extinguishing medium is sprayed almost horizontally towards the tarpaulin into an upper peripheral area in the vicinity of the trailer ceiling 15. The last-mentioned part prevents the flue gases from rapid and sudden ignition and prevents the fire from spreading to other zones, like zone 16 in the railway carriage.

Figure 4:
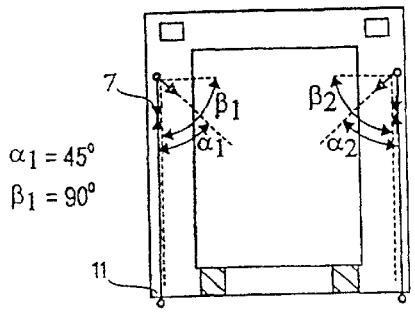

FIGS. 4 to 6 show alternative spray and spread angles to the ones in FIG. 2 for the spray heads. The angle $\alpha 1$ in relation to the vertical plane ranges from 40 to 70°, preferably from 45 to 60°. The spread angle $\beta 1$, $\beta 2$ ranges from 45 to 120°, preferably from 90 to 120°.

The height of the spray heads 1, 2 above the floor 11 ranges from 3,2 to 4 m, preferably 3,4 to 3,8 m. Preferably no spray heads are positioned close to the side walls 3, 4 at a height of 0,5 to 3 m from the railway carriage floor 11.

FIG. 7 shows a fire fighting installation according to the invention mounted in a car tunnel 5'. Alternatively the tunnel could also be a train tunnel. In the figure has been used similar reference numbers as in FIGS. 1 and 2 for similar components. Accordingly, reference numeral 50' designates a high pressure drive source, for feeding water-based liquid into a pipe system 6. The spray heads 1', 2' are placed along the side walls 3', 4' of the tunnel in the same way as in the railway carriage in FIG. 1. The spray heads 1', 2' are placed at an angle $\alpha'1$, and $\alpha'2$ respectively, which is 60° in relation to a vertical plane. It is assumed that the angles $\alpha'1$, $\alpha^{-\prime}2$ ranging from 40 to 70° and preferably from 45 to 60° provide good results in view of fire fighting and extinguishing. An appropriate angle depends on the height of the spray heads 1', 2' above the floor level 11' of the tunnel and on their distance from the object, i.e. the vehicle/trailer/goods that is to be protected in case of fire. The spread angle $\beta 1$, $\beta 2$ is 45°, and is narrow compared with the spread angle in FIGS. 1 to 6. This is due to the fact that the tunnel 5' is wide in relation to the width of the railway carriage in FIGS. 1 to 6, whereby the distance of the spray heads 1', 2' from the object that is to be protected exceeds the one shown in FIGS. 1 to 6. It is assumed that in a tunnel the spread angles $\beta 1$, $\beta 2$ ranging from 45 to 120° and here preferably from 90 to 120° provide good results.

The invention has above been described only with reference to examples and it is therefore pointed out that the details of the invention may vary in many ways within the scope of the attached claims. Thus the installation can be employed in other spaces than railway carriages, for transportation of lorries, trailers and the like.

What is claimed is:

1. An installation for fighting fire in a space, the space being bounded by a first longitudinal side wall; the installation comprising at least two spray heads whereof the first spray head is placed in the space close to the first longitudinal side wall and obliquely directed downwards at an angle of 40 to 70° in relation to a vertical plane and the and the second spray head is placed in the space close to a second longitudinal side wall of the space opposite the first side wall and obliquely directed downwards at an angle of 40 to 70° in relation to the vertical plane, and a drive source for feeding extinguishing medium to said at least two spray heads, wherein -the drive source is a high pressure drive source for feeding the extinguishing medium at a pressure of at least 15 bar, -the extinguishing medium is a water-based extinguishing medium, and -said two spray heads are placed at a height of 3,2 to 4 m above the floor of the space and arranged to spray water-based extinguishing medium at a spread angle of 45 to 120° and comprise at least two nozzles which are placed and directed in such a way that the spray heads at high pressure provide, in the direction in which the spray heads are directed, a mist-like spray with strong penetration power, and a suction at the respective spray head for sucking in flue gases into the spray of extinguishing medium and for enhancing the vaporization of the extinguishing medium.

2. An installation as claimed in claim 1, wherein the spray heads are at least mainly directed against each other, and are thus arranged to spray away from the respective side wall close to which the spray heads are placed.

3. An installation as claimed in claim 2, wherein the area close to the side walls of the space and at a height of 0,5 to 3 m above the floor of the space is free from spray heads.

4. An installation as claimed in claim 1, wherein the spray heads are directed at an angle of 45 to 60° in relation to the vertical plane.

5. An installation as claimed in claim 4, wherein the area close to the side walls of the space and at a height of 0,5 to 3 m above the floor of the space is free from spray heads.

6. An installation as claimed in claim 1, wherein the spray heads are placed at a height of 3,4 to 3,8 m above the floor of the space.

7. An installation as claimed in claim 6, wherein the area close to the side walls of the space and at a height of 0,5 to 3 m above the floor of the space is free from spray heads.

8. An installation as claimed in claim 1, wherein the spray heads are arranged to spray at a spread angle of 90 to 120°.

9. An installation as claimed in claim 8, wherein the area close to the side walls of the space and at a height of 0,5 to 3 m above the floor of the space is free from spray heads.

10. An installation as claimed in claim 1, wherein the spray heads are arranged to deliver extinguishing medium in an area extending from a lower peripheral area, which mainly extends straight downwards towards the floor of the space, to an upper peripheral area, which mainly extends horizontally regarding the floor of the space.

11. An installation as claimed in claim 10, wherein the upper peripheral area extends maximally about 30° upwards regarding the floor level.

12. An installation as claimed in claim 10, and comprising several spray heads extending in the longitudinal direction of the railway carriage placed along both side walls of the space.

13. An installation as claimed in claim 1, wherein the spray heads comprise a central nozzle which is surrounded by a plurality of obliquely placed nozzles.

14. An installation as claimed in claim 1, wherein the area close to the side walls of the space and at a height of 0,5 to 3 m above the floor of the space is free from spray heads.

15. An installation as claimed in claim 14, wherein the width of the space is 3 to 5 m.

16. An installation as claimed in claim 15, wherein the space is a railway carriage.

17. An installation as claimed in claim 1, wherein the space is a railway carriage for transportation of lorries and/or trailers.

18. An installation for fighting fire in a tunnel, said installation comprising a high pressure drive source containing water-based extinguishing medium, and at lest two spray heads, said drive source being adapted to feed water-based extinguishing medium to the spray heads, whereof the first spray head is placed close to a first longitudinal side wall of the tunnel and obliquely directed downwards at an angle of 40 to 70° in relation to a vertical plane, and the second spray head is placed close to a second longitudinal side wall of the tunnel opposite the first side wall and obliquely directed downwards at an angle of 40 to 70° in relation to the vertical plane, the spray heads being placed at a height of 3.2 to 4 m above the floor level of the tunnel and arranged to spray water-based extinguishing medium at a a spread angle of 45 to 120°.

19. An installation as claimed in claim 18, wherein the spray heads comprise at least two nozzles which are placed and directed in such a way that the spray heads at high pressure provide, in the direction in which the spray heads are directed, a mist-like spray with strong penetration power, and a suction at the respective spray head for sucking in flue gases into the spray of extinguishing medium and for enhancing the vaporization of the extinguishing medium.

20. An installation as claimed in claim 18, wherein the tunnel is a car or train tunnel.

* * * * *